US009357820B2

(12) United States Patent
Pao

(10) Patent No.: US 9,357,820 B2
(45) **Date of Patent: *Jun. 7, 2016**

(54) FOLDABLE CHAIR

(71) Applicant: STEP2GOLD CO., LTD., Taichung (TW)

(72) Inventor: Chih-Ting Pao, Taichung (TW)

(73) Assignee: STEP2GOLD CO., LTD., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/583,468

(22) Filed: Dec. 26, 2014

(65) Prior Publication Data

US 2015/0196103 A1 Jul. 16, 2015

(30) Foreign Application Priority Data

Jan. 14, 2014 (TW) ..... 103101267 A

(51) Int. Cl.

| | |
|---|---|
| ***A45B 3/00*** | (2006.01) |
| ***A45B 5/00*** | (2006.01) |
| ***A47C 9/10*** | (2006.01) |
| ***A47C 4/04*** | (2006.01) |
| ***A47C 4/18*** | (2006.01) |
| *A45B 25/16* | (2006.01) |

(52) U.S. Cl.

CPC ... *A45B 5/00* (2013.01); *A47C 4/04* (2013.01); *A47C 4/18* (2013.01); *A47C 9/105* (2013.01); *A45B 25/16* (2013.01)

(58) Field of Classification Search

CPC ..... A45B 5/00; A45B 25/16

USPC ..... 297/55, 118, 16.2, 16.1, 183.5; 135/66

See application file for complete search history.

(56) References Cited

U.S. PATENT DOCUMENTS

| | | | | |
|---|---|---|---|---|
| 2,380,437 | A | 7/1945 | Homrighausen | |
| 2,689,603 | A * | 9/1954 | Smith | A47C 4/38 248/155.5 |
| 3,310,340 | A * | 3/1967 | Brewer | A45B 5/00 108/128 |
| 8,997,766 | B2 * | 4/2015 | Pao | A47C 4/04 135/66 |
| 2013/0307297 | A1 * | 11/2013 | Huang | A47C 3/04 297/16.1 |
| 2014/0034097 | A1 * | 2/2014 | Pao | A45B 5/00 135/66 |
| 2014/0034098 | A1 * | 2/2014 | Pao | A45B 5/00 135/66 |

FOREIGN PATENT DOCUMENTS

| | | | |
|---|---|---|---|
| TW | 201438634 | A | 10/2014 |

* cited by examiner

*Primary Examiner* — Chi Q Nguyen
(74) *Attorney, Agent, or Firm* — DLA Piper LLP (US)

(57) ABSTRACT

A foldable chair includes a support unit, a fold unit and a seat unit. The support unit includes a main stick having a positioning groove. The fold unit includes a connecting member connected to the main stick and an upper slider assembly movable along the main stick. The seat unit is connected to the upper slider assembly. The upper slider assembly is operable to engage the positioning groove for preventing the fold unit from converting between an unfolded state and a folded state, and to be disengaged from the positioning groove so as to permit the fold unit to convert between the unfolded and folded states.

11 Claims, 11 Drawing Sheets

FOLDABLE CHAIR

CROSS-REFERENCE TO RELATED APPLICATIONS

This application claims priority of Taiwanese Application No. 103101267, filed on Jan. 14, 2014.

FIELD OF THE INVENTION

The invention relates to a chair, more particularly to a foldable chair.

BACKGROUND OF THE INVENTION

A foldable chair may be configured as a walking stick chair for use of people having inferior physical condition. U.S. Pat. No. 2,380,437 discloses a conventional walking stick chair including a stick and a sleeve slidable along the stick. The conventional walking stick chair is convertible between a folded state and an unfolded state by moving the sleeve along the stick. The sleeve can be positioned relative to the stick for retaining the conventional walking stick chair in the folded or unfolded state by virtue of a screw that is threaded drivingly to the sleeve. However, operation of the sleeve and the screw to convert the states of the conventional walking stick is inconvenient.

Taiwanese Patent Application No. 102112330 discloses another conventional walking stick chair including a stick and a sleeve that can be positioned relative to the stick through an easier operation. However, a positioning structure of the conventional walking stick chair is complex and therefore may raise the manufacturing cost of the conventional walking stick chair.

SUMMARY OF THE INVENTION

Therefore, the object of the present invention is to provide a foldable chair that can overcome at least one of the aforesaid drawbacks associated with the prior arts.

Accordingly, a foldable chair of the present invention includes a support unit, a fold unit and a seat unit. The support unit includes a main stick that extends along an axis. The main stick has a guide groove that is formed in an outer surrounding surface of the main stick and that extends in a longitudinal direction of the main stick, and a positioning groove that is formed in the outer surrounding surface, and that has a portion extending in a circumferential direction of the main stick and communicating spatially with the guide groove. The fold unit includes a connecting member that is connected to the main stick, an upper slider assembly that is connected to the main stick, that is located above the connecting member, and that is movable along the main stick, a fold bar that has a proximal end connected pivotally to the connecting member and a free end opposite to the proximal end, and a linking bar that has opposite ends connected respectively and pivotally to the upper slider assembly and the fold bar. The fold unit is operable to convert between an unfolded state and a folded state such that, when the fold unit is converted from the unfolded state into the folded state, a distance between the upper slider assembly and the connecting member is increased and a distance between the free end of the fold bar and the main stick is reduced. The seat unit has a proximal end portion that is connected to the upper slider assembly, and a distal end portion that is opposite to the proximal end portion. The seat unit forms an angle relative to the main stick, and is supported by the fold bar when the fold unit is in the unfolded state. The distal end portion of the seat unit is moved toward the main stick when the fold unit is converted into the folded state. The upper slider assembly includes a slider member and a rotating member that is connected rotatably to the slider member. The rotating member is rotatable relative to the slider member about the axis between a looking position, where the rotating member engages the positioning groove for positioning the upper slider assembly relative to the main stick and the connecting member, so as to prevent conversion of the told unit between the unfolded state and the folded state, and an unlocking position, where the rotating member is disengaged from the positioning groove, so as to permit the conversion of the fold unit between the unfolded state and the folded state.

BRIEF DESCRIPTION OF THE DRAWINGS

Other features and advantages of the present invention will become apparent in the following detailed description of the embodiment with reference to the accompanying drawings, of which.

DETAILED DESCRIPTION OF THE EMBODIMENT

Figure 1:
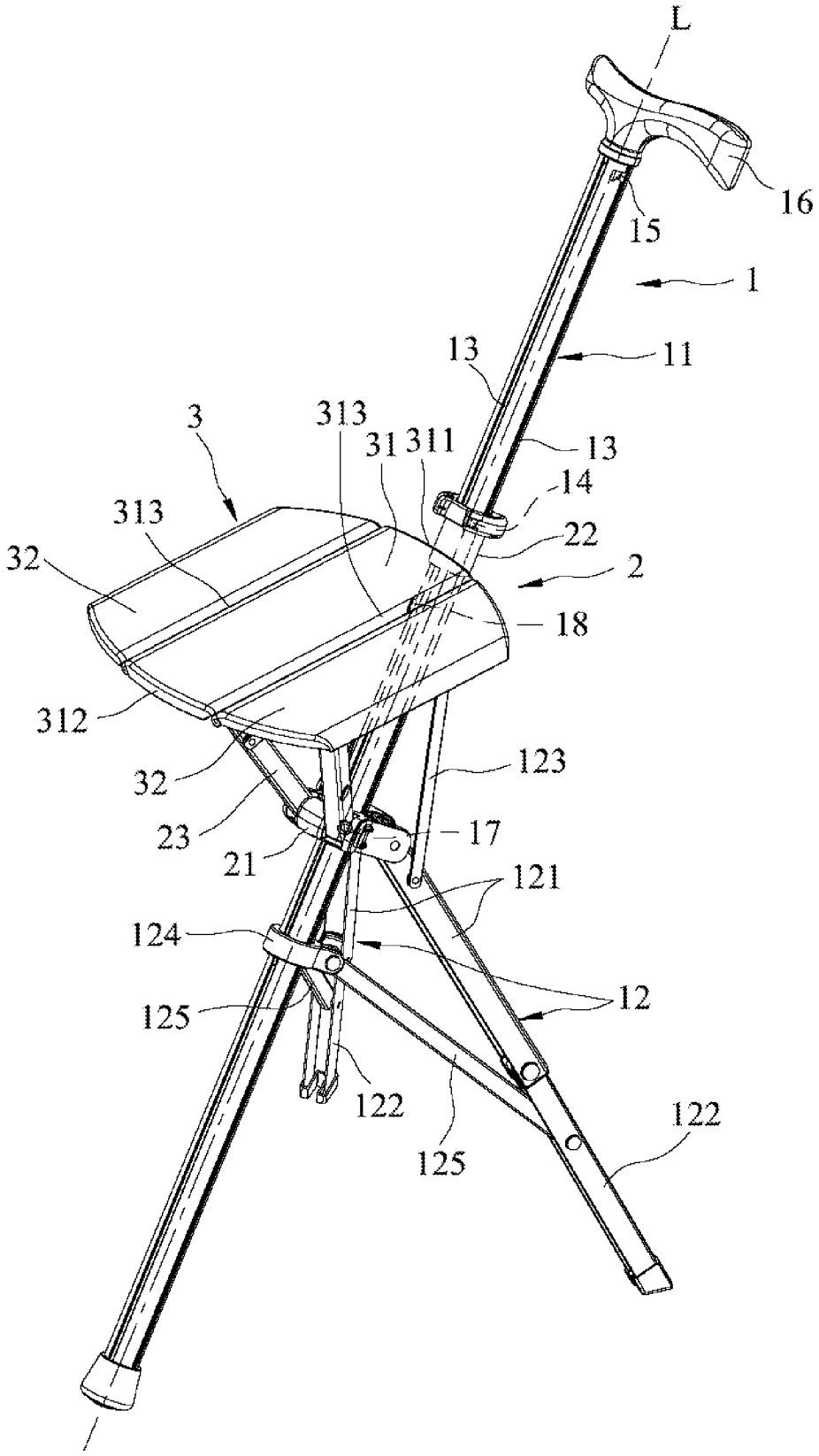
FIG. 1 is a perspective view of an embodiment of a foldable chair according to the invention.
Figure 2:
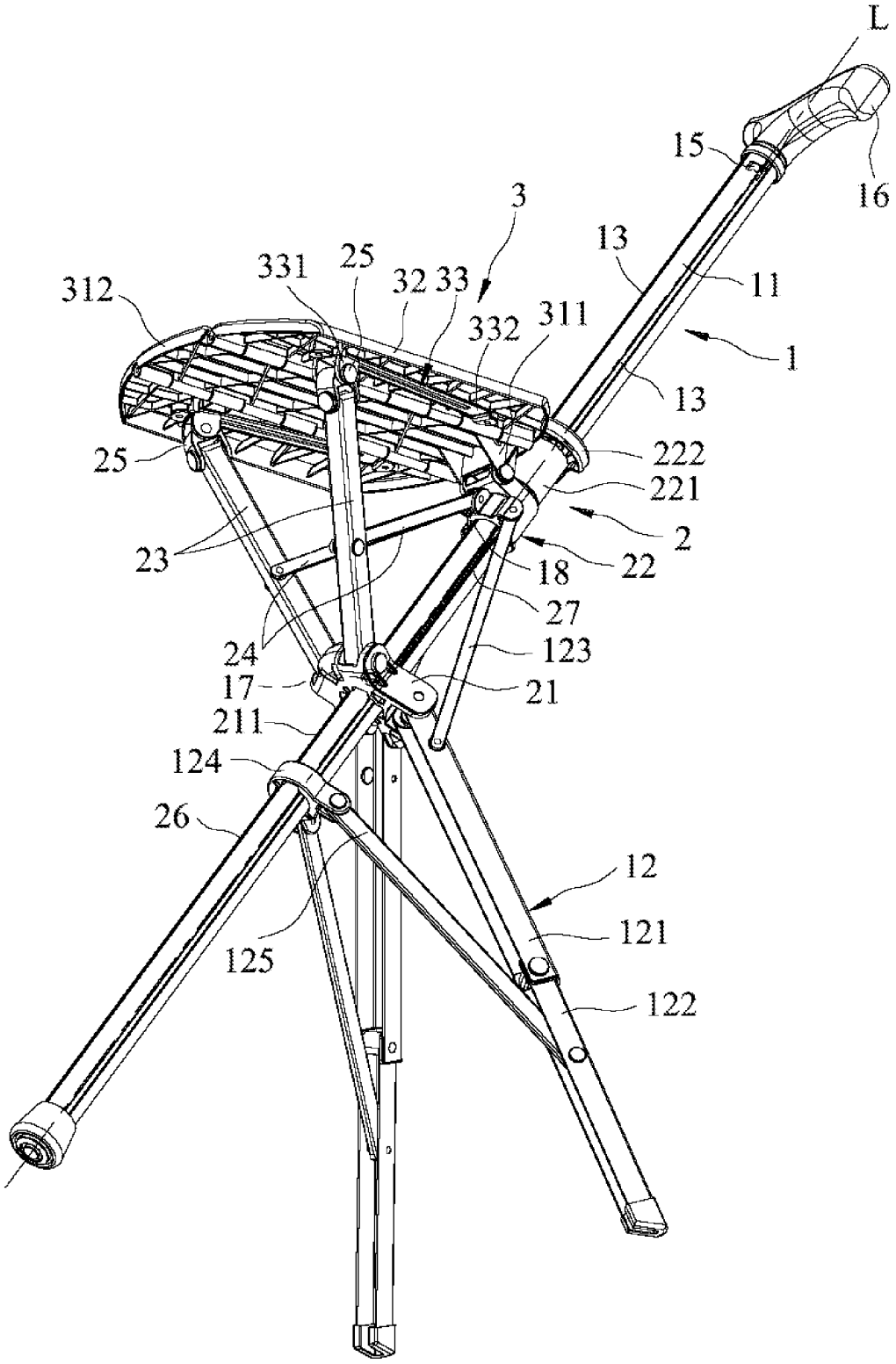
FIG. 2 is another perspective view of the embodiment illustrating the embodiment being unfolded.

As shown in FIGS. 1 and 2, an embodiment of a foldable chair according to the present invention is configured as a walking stick chair, and includes a support unit 1, a fold unit 2 and a seat unit 3.

The support unit 1 includes a main stick 11, two support legs 12 and a handle 16.

The main stick 11 extends along an axis (L), and has four guide grooves 13 (only two are shown), two lower positioning grooves 14 (only one is shown) and two upper positioning grooves 15 (only one is shown). The lower positioning grooves 14 are distal from an upper end of the main stick 11. The upper positioning grooves 15 are proximate to the upper end of the main stick 11. The handle 16 is connected to the upper end of the main stick 11.

The guide grooves 13 are formed in an outer surrounding surface of the main stick 11, extend in a longitudinal direction of the main stick 11, and are angularly spaced apart from each other. In this embodiment, the main stick 11 is configured as a tubular rod that has a tubular wall. Each of the guide grooves 13 has a depth greater than the thickness of the tubular wall, and is configured to enhance the structural strength of the main stick 11.

The lower positioning grooves 14 are formed in the outer surrounding surface of the main stick 11, are diametrically opposite to each other, extend in a circumferential direction of the main stick 11, and communicate spatially and respectively with two of the guide grooves 13 that are diametrically opposite to each other.

Figure 9:
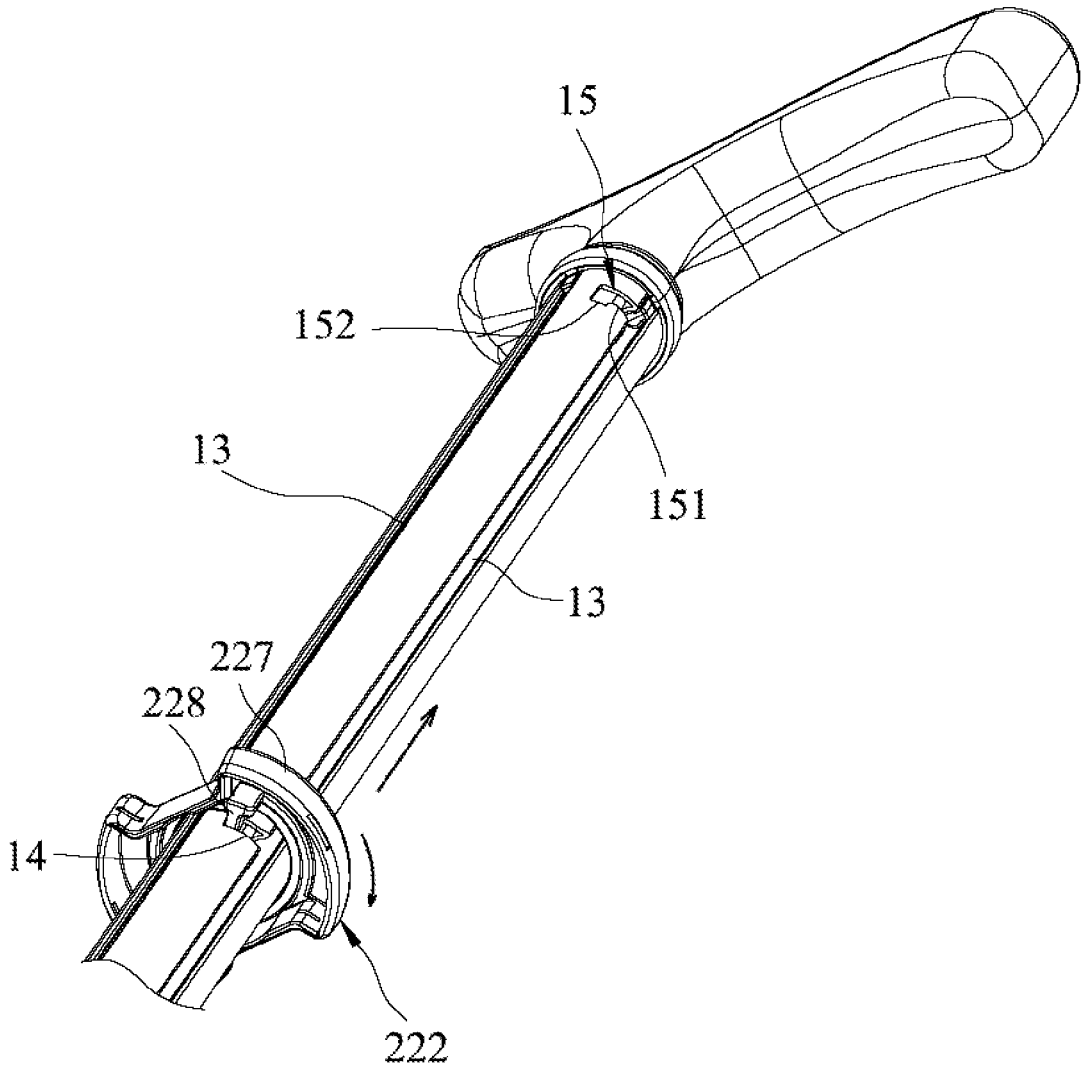
FIG. 9 is a schematic fragmentary perspective view of the embodiment illustrating the rotating member engaging a lower positioning groove.

The upper positioning grooves 15 are formed in the outer surrounding surface of the main stick 11, are diametrically opposite to each other, and communicate spatially and respectively with the two of the guide grooves 13, Referring further to FIG. 9, each of the upper positioning grooves 15 has a slide section 151 that extends in the circumferential direction of the main stick 11 and that communicates spatially with the respective one of the two of the guide grooves 13, and a prevention section 152 that extends away from the upper end of the main stick 11 from one end of the slide section 151 distal from the respective one of the two of the guide grooves 13.

It is noted that the main stick 11 may have only one guide groove 13, one lower positioning groove 14 and one upper positioning groove 15, or other numbers of the guide grooves 13, the lower positioning grooves 14 and the upper positioning grooves 15. Moreover, in a variation of the embodiment, the lower positioning grooves 14 or the upper positioning groove 15 may be omitted.

The fold unit 2 includes a connecting member 21, an upper slider assembly 22, two fold bars 23, two linking bars 24, two pivoting connectors 25, two first resilient members 26 (only one is shown) and two second resilient members 27 (only one is shown).

The connecting member 21 is connected to and slidable along the main stick 11. The upper slider assembly 22 is connected to the main stick 11, is located above the connecting member 21, and is slidable along the main stick 11. Each of the fold bars 23 has a proximal end connected pivotally to the connecting member 21 and a free end opposite to the proximal end. Each of the linking bars 24 has opposite ends connected respectively and pivotally to the upper slider assembly 22 and a respective one of the fold bars 23.

The fold unit 2 is operable to converted between an unfolded state (see FIG. 2) where the upper slider assembly 22 is proximate to the connecting member 21 and where the free end of each of the fold bars 23 is distal from the main stick 11, and a folded state (see FIGS. 3 and 11) where the upper slider assembly 22 is distal from the connecting member 21 and where the free end of each of the fold bars 23 is proximate to the main stick 11, such that, when the fold unit 2 is converted from the unfolded state into the folded state, a distance between the upper slider assembly 22 and the connecting member 21 is increased and a distance between the free end of each of the fold bars 23 and the main stick 11 is reduced.

Figure 12:
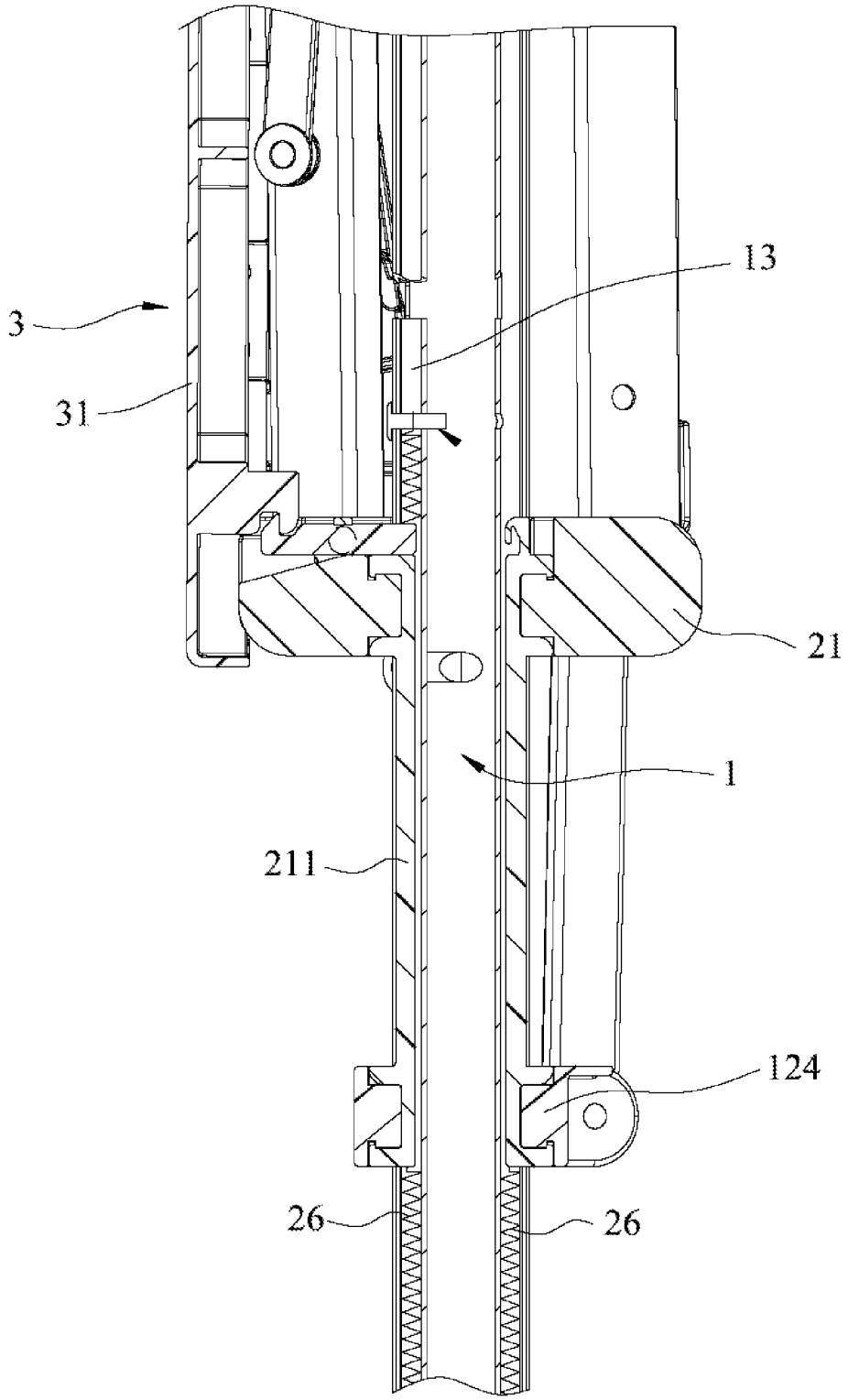
FIG. 12 is a fragmentary sectional view of the embodiment illustrating a seat unit being positioned when the embodiment is folded.

Referring to FIG. 12, the fold unit 2 further includes a lower slider member 124 that is connected to and slidable along the main stick 11, and a connecting rod 211 that interconnects co-movably the connecting member 21 and the lower slider member 124.

Each of the support legs 12 of the support unit 1 includes an upper leg component 121 that has a proximal end connected pivotally to the connecting member 21, and a distal end opposite to the proximal end, a lower leg component 122 that has a pivoted end connected pivotally to the distal end of the upper leg component 121, and a free end opposite to the pivoted end, a drive link 123 that has opposite ends connected pivotally and respectively to the upper leg component 121 and the upper slider assembly 22, and an auxiliary link 125 that has opposite ends connected pivotally and respectively to the lower leg component 122 and the lower slider member 124.

Figure 4:
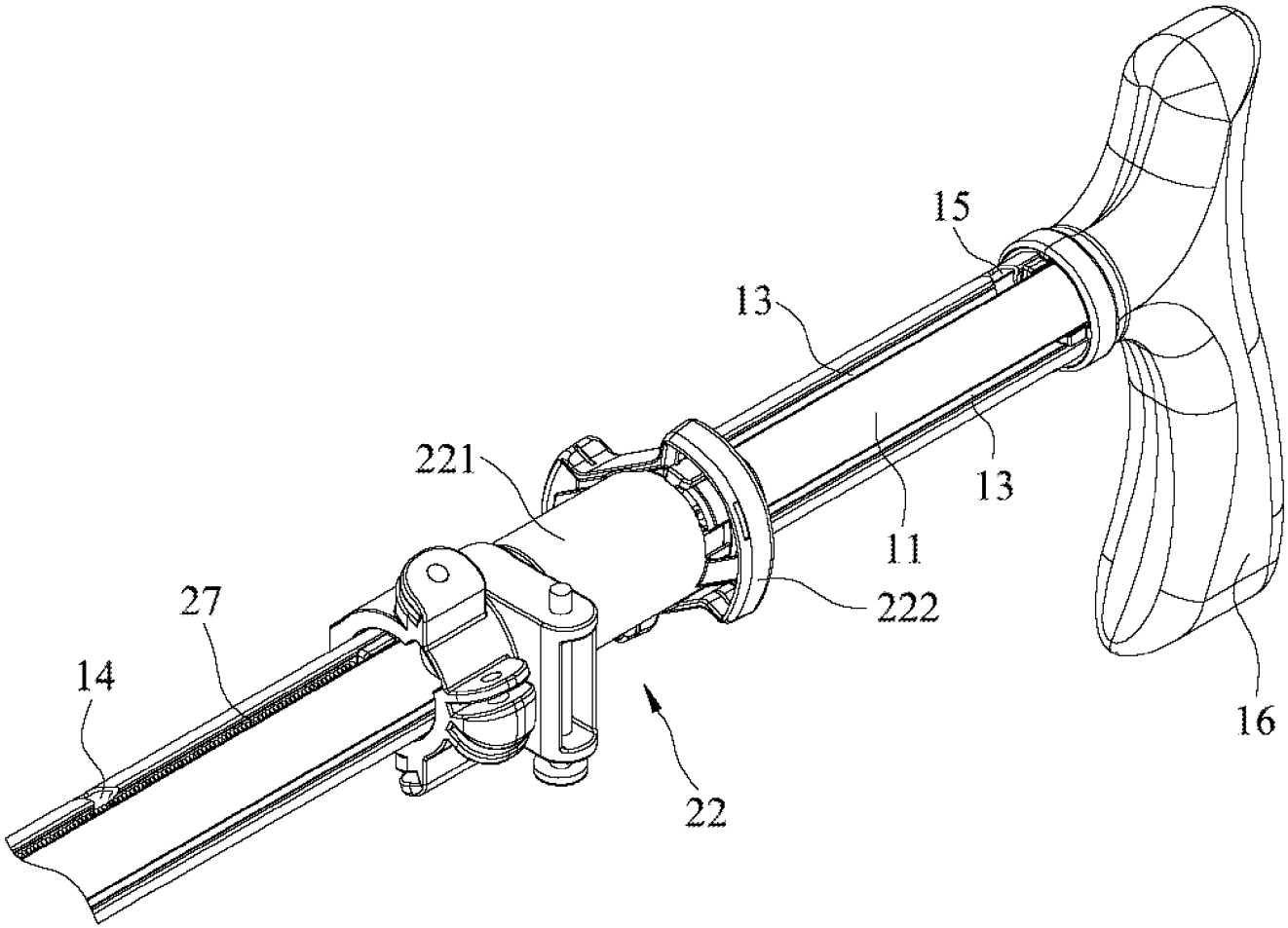
FIG. 4 is a fragmentary perspective view of the embodiment illustrating a main stick and an upper slider assembly.
Figure 5:
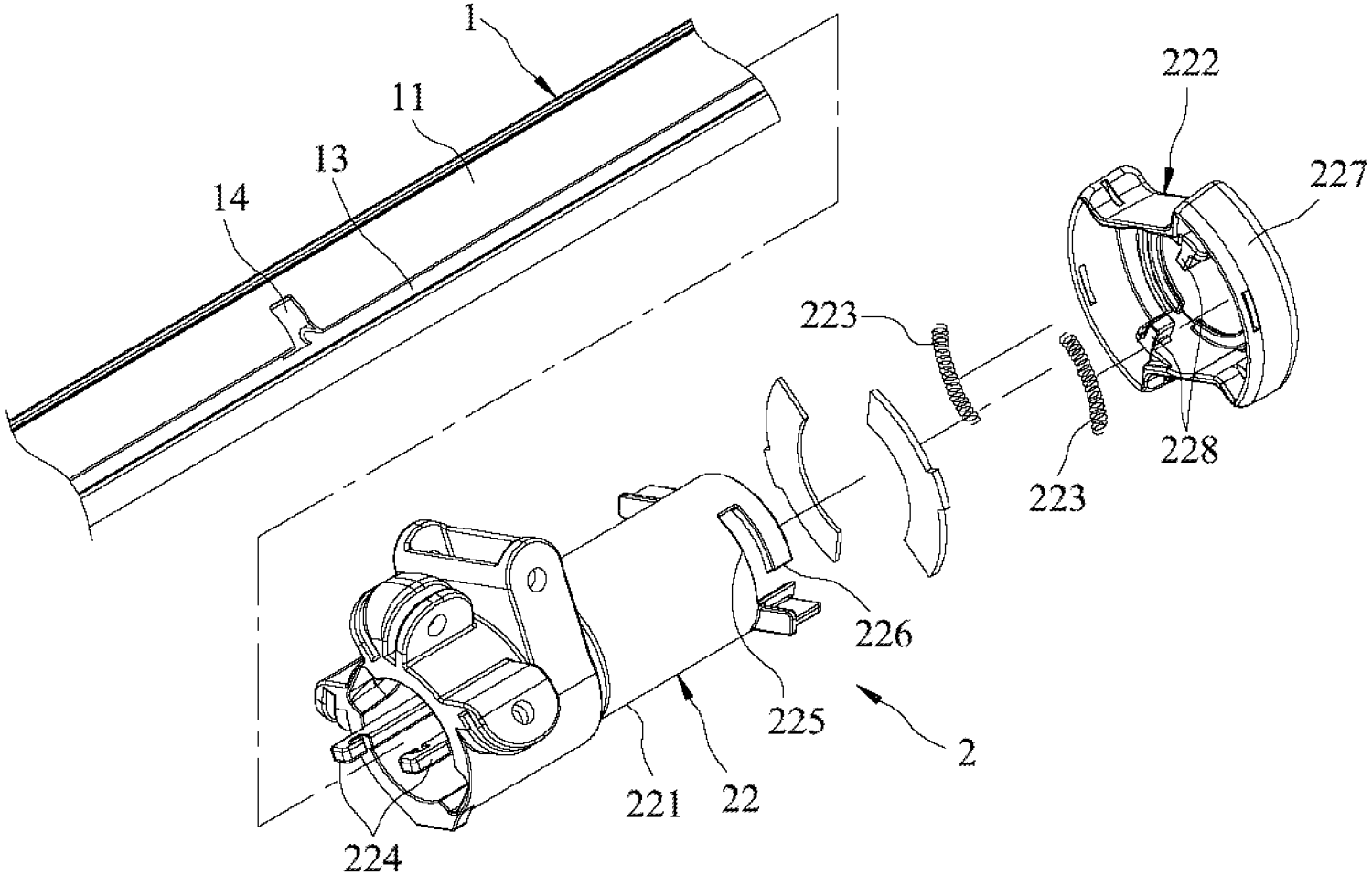
FIG. 5 is an exploded perspective view of the upper slider assembly.
Figure 6:
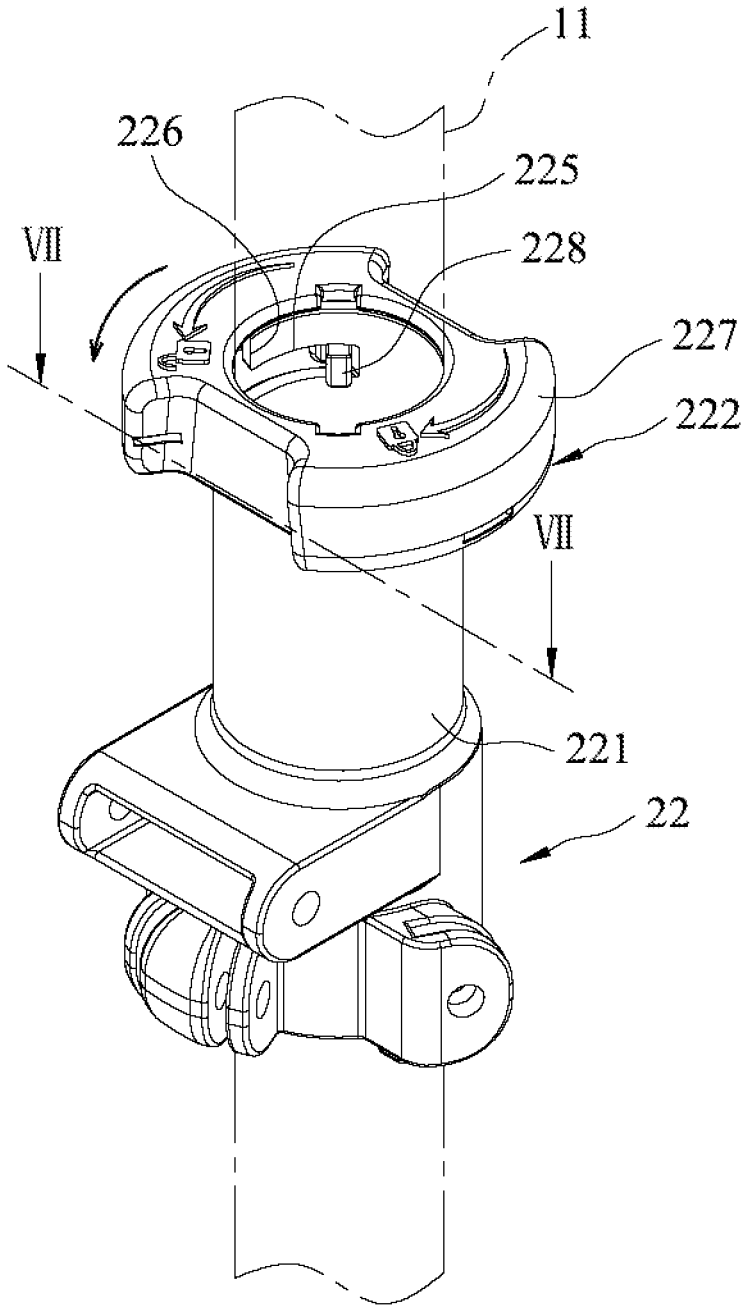
FIG. 6 is a schematic perspective view of the upper slider assembly.

Referring to FIGS. 4, 5 and 6, the upper slider assembly 22 includes a slider member 221, a rotating member 222 and two locking resilient members 223.

The slider member 221 has two engaging protrusions 224 engaging slidably and respectively two of the guide grooves 13, and is formed with two block-engaging grooves (only one is shown) each having a slide groove portion 225 that extends in the circumferential direction of the main stick 11, and an installation groove portion 226 that extends from the slide groove portion 225 and through an upper end of the slider member 221.

The rotating member 222 is connected rotatably to the slider member 221, and has a cap body 227 and two engaging blocks 228 that project from the cap body 227. Each of the engaging blocks 228 is slidable within the slide groove portion 225 of a respective one of the block-engaging grooves. During assembly of the rotating member 222 and the slider member 221, each of the engaging blocks 228 enters the slide groove portion 225 of the respective one of the block-engaging grooves via the installation groove portion 226 of the respective one of the block-engaging grooves.

Figure 7:
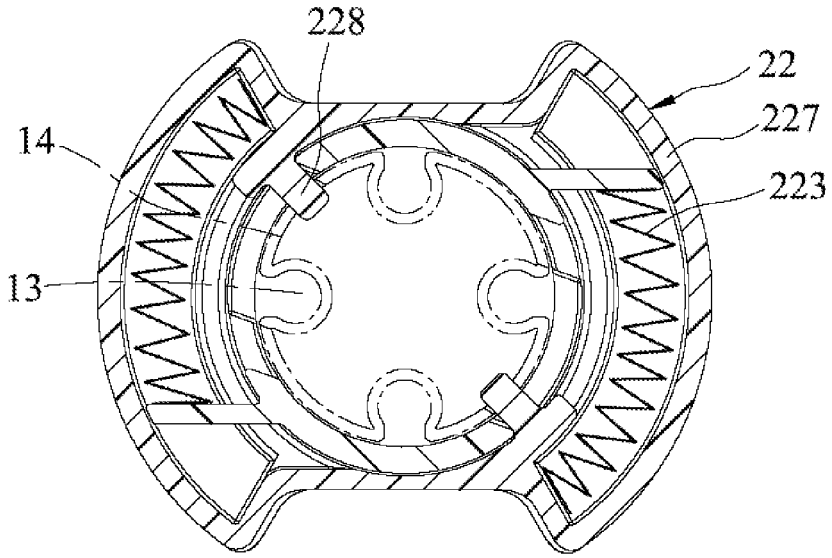
FIG. 7 is a schematic sectional view of the upper slider assembly taken along line VII-VII in FIG. 6, illustrating a rotating member of the upper slider assembly at a locking position.
Figure 8:
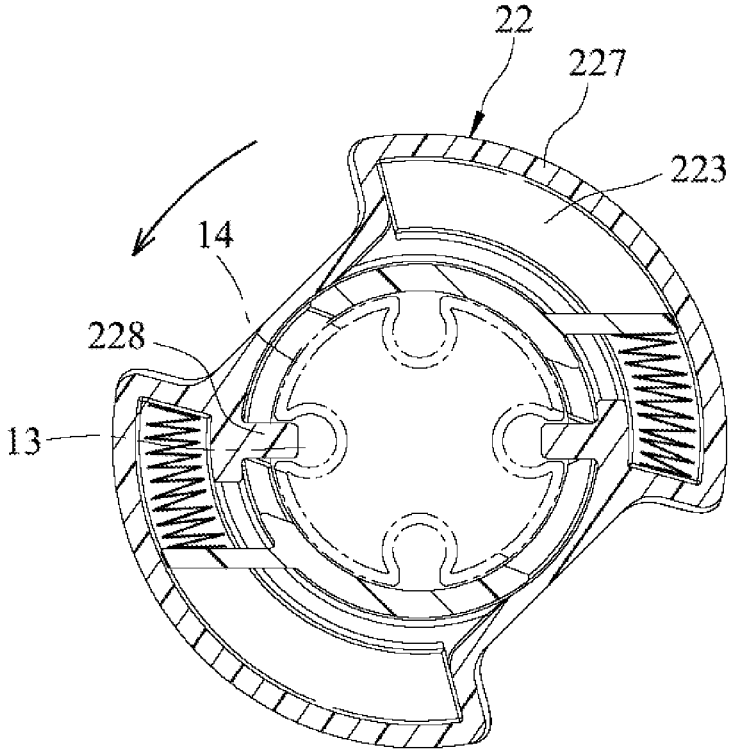
FIG. 8 is another schematic sectional view similar to FIG. 7 but illustrating that the rotating member is at an unlocking position.

The rotating member 222 is rotatable relative to the slider member 221 about the axis (L) between a locking position (see FIG. 7), where the engaging blocks 228 of the rotating member 222 engage respectively the upper positioning grooves 15 or engage respectively the lower positioning grooves 14 for positioning the upper slider assembly 22 relative to the main stick 11 and the connecting member 21, so as to prevent conversion of the fold unit 2 between the unfolded state and the folded state, and an unlocking position (see FIG. 8), where the engaging blocks 228 of the rotating member 22 are disengaged from the upper and lower positioning grooves 15, 14, and are slidable respectively within the two of guide groves 13, so as to permit the conversion of the fold unit 2 between the unfolded state and the folded state.

Each of the locking resilient members 223 is configured as a compression spring, and has opposite ends pushing respectively against the slider member 221 and the rotating member 222 for biasing resiliently the rotating member 222 toward the locking position.

The first resilient members 26 are received respectively in two of the guide grooves 13. Each of the first resilient members 26 is configured as a tension spring, and has opposite ends connected respectively to the lower slider member 124 and a pin member 111 (see FIG. 11) mounted fixedly in the main stick 11 for biasing resiliently the lower slider member 124 and the connecting member 21 away from the upper end of the main stick 11.

The second resilient members 27 are received respectively in two of the guide grooves 13. Each of the second resilient members 27 is also configured as a tension spring, and has opposite ends connected respectively to the connecting member 21 and a respective one of the engaging protrusions 224 of the slider member 221 of the upper slider assembly 22 for biasing resiliently the connecting member 21 and the upper slider assembly 22 toward each other.

The seat unit 3 includes a main plate 31 that has a proximal end portion 311 connected pivotally to the upper slider assembly 22, and a distal end portion 312 opposite to the proximal end portion 311, and two lateral plates 32 that are connected respectively and pivotally to opposite lateral sides 313 of the main plate 31. Each of the lateral plates 32 has a guide rail 33 that has a proximal end 332 proximate to the proximal end portion 311 of the main plate 31, and a distal end 331 distal from the proximal end portion 311 of the main plate 31. Each of the pivoting connectors 25 of the fold unit 2 interconnects pivotally the free end of a respective one of the fold bars 23 and a respective one of the lateral plates 32, and is slidable along the guide rail 33 of the respective one of the lateral plates 32.

It is noted that in a variation of the embodiment, the pivoting connectors 25 may be omitted, and the seat unit 3 may be configured as a flexible fabric that is made of canvas. A proximal end portion of the seat unit 3 is connected to the upper slider assembly 22. A distal end portion of the seat unit 3 is connected to the free ends of the fold bars 23.

Referring back to FIGS. 1 and 2, when the fold unit 2 is in the unfolded state, the foldable chair of this invention is unfolded such that: the connecting member 21 is biased by the first resilient members 26 to abut against a lower limiting member 17 that is connected fixedly to the main stick 11, so as to be positioned relative to the main stick 11; the upper slider assembly 22 is biased by the second resilient members 27 to abut against an upper limiting member 18 that is connected fixedly to the main stick 11, so as to be positioned relative to the main stick 11; the distal end of the upper leg component 121 of each of the support legs 12 is distal from the main stick 11; the free end of the lower leg component 122 of each of the support legs 12 is distal from the main stick 11 for contacting ground; the main plate 31 and the lateral plates 32 are coplanar to form an angle relative to the main stick 11, and are supported by the fold bars 23; each of the pivoting connectors 25 is at the distal end 331 of the guide rail 33 of the respective one of the lateral plates 32; and the rotating member 222 is at the locking position where the engaging blocks 226 of the rotating member 222 engage respectively the lower positioning grooves 14 for retaining the fold unit 2 in the unfolded state.

Referring to FIG. 9, to fold the foldable chair of this invention, the rotating member 222 is first rotated to the unlocking position against the biasing action of the locking resilient members 223, such that the engaging blocks 228 of the rotating member 222 are disengaged respectively from the lower positioning grooves 14, and are slidable respectively within the two of the guide grooves 13 to permit the upper slider assembly 22 to slide along the main stick 11. Then, the upper slider assembly 22 is moved upwardly toward the handle 16 to drive the connecting member 21 to move toward the handle 16 until the connecting member 21 is positioned relative to the main stick 11 by a positioning mean. With further upward movement of the upper slider assembly 22, the fold unit 2 is converted into the folded state.

Figure 3:
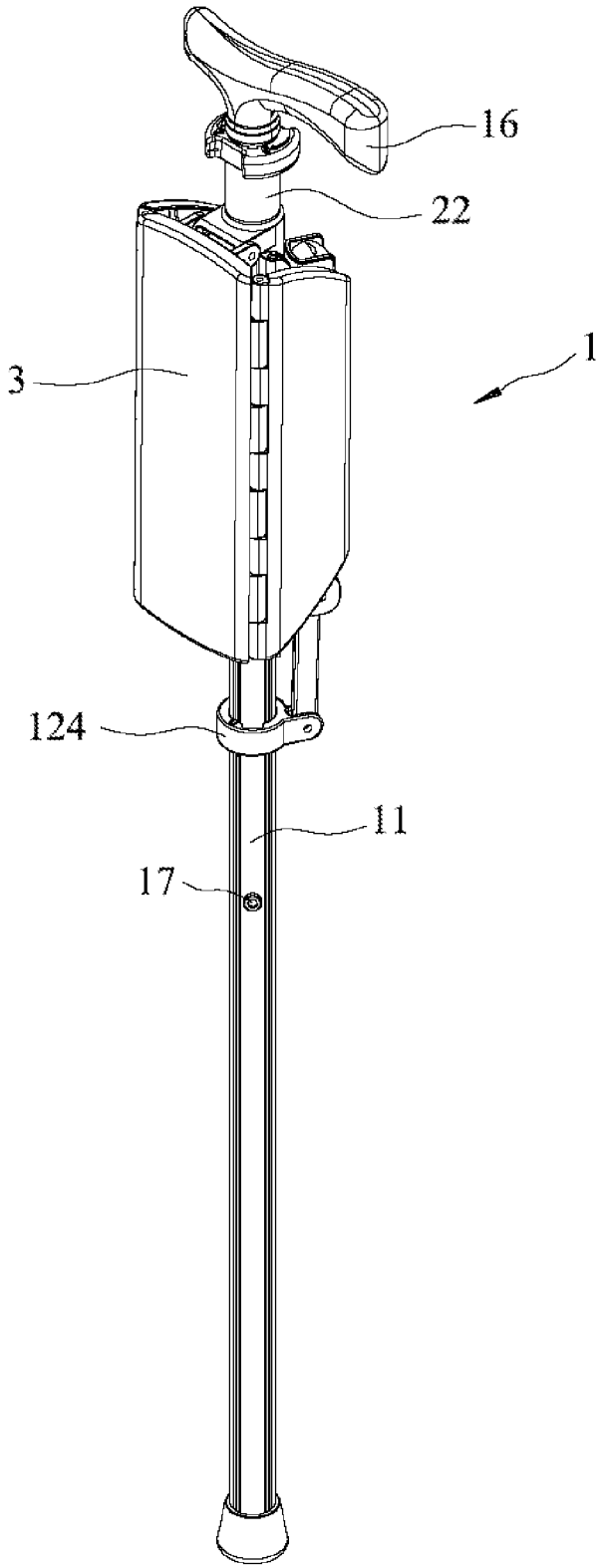
FIG. 3 is still another perspective view of the embodiment illustrating the embodiment being folded.
Figure 11:
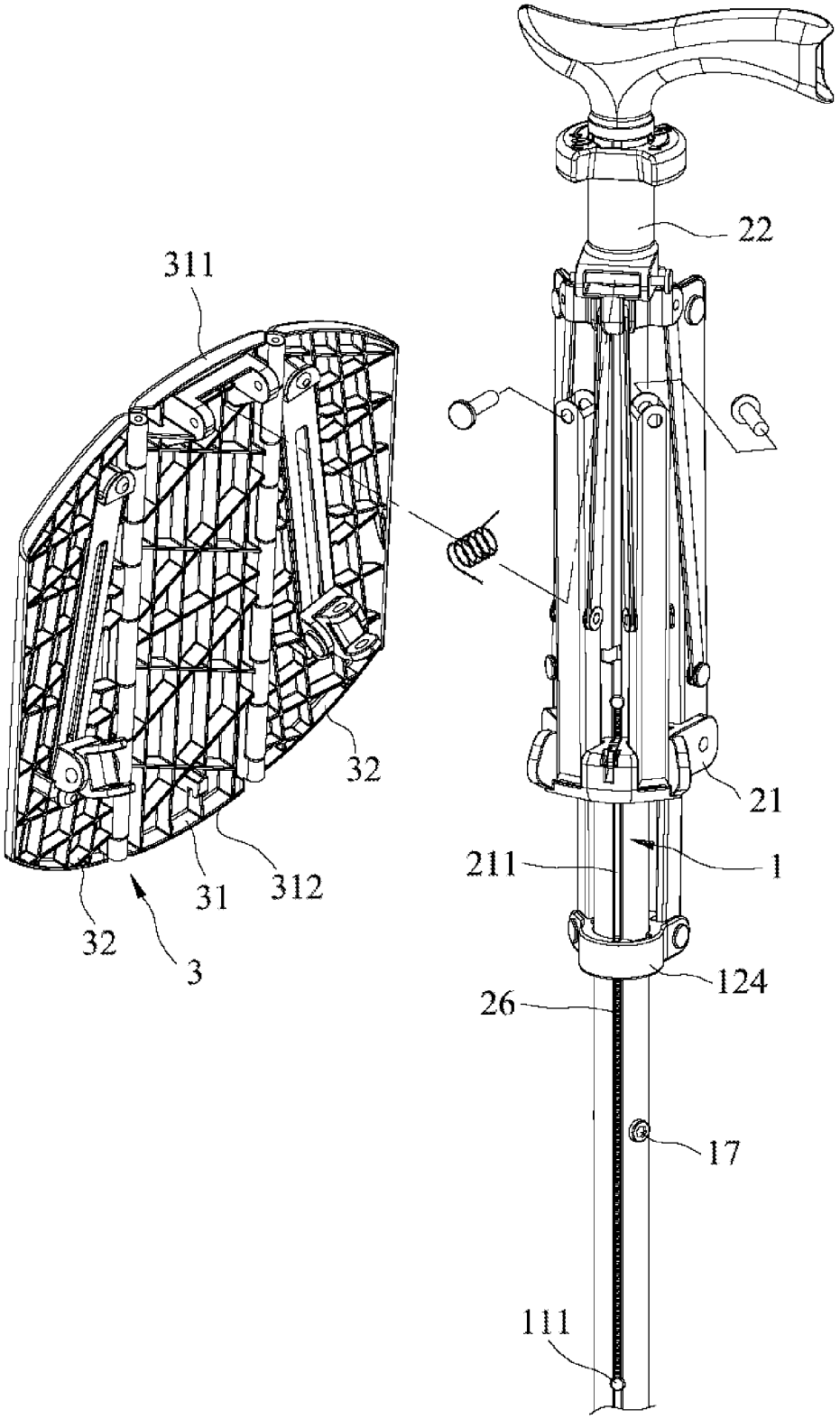
FIG. 11 is a partly exploded perspective view of the embodiment illustrating that the embodiment is folded.

Referring to FIGS. 3, 11 and 12, when the fold unit 2 is in the folded state, the foldable chair is folded such that: the distal end of the upper leg component 121 of each of the support legs 12 is proximate to the main stick 11; the free end of the lower leg component 122 of each of the support legs 12 is proximate to the main stick 11; each of the pivoting connectors 25 is at the proximal end 332 of the guide rail 33 of the respective one of the lateral plates 32; the distal end portion 312 of the seat unit 3 is proximate to the main stick 11; and the main plate 31 and the lateral plates 32 cooperatively form a U-shaped structure to cover the fold unit 2 and the support legs 12.

Figure 10:
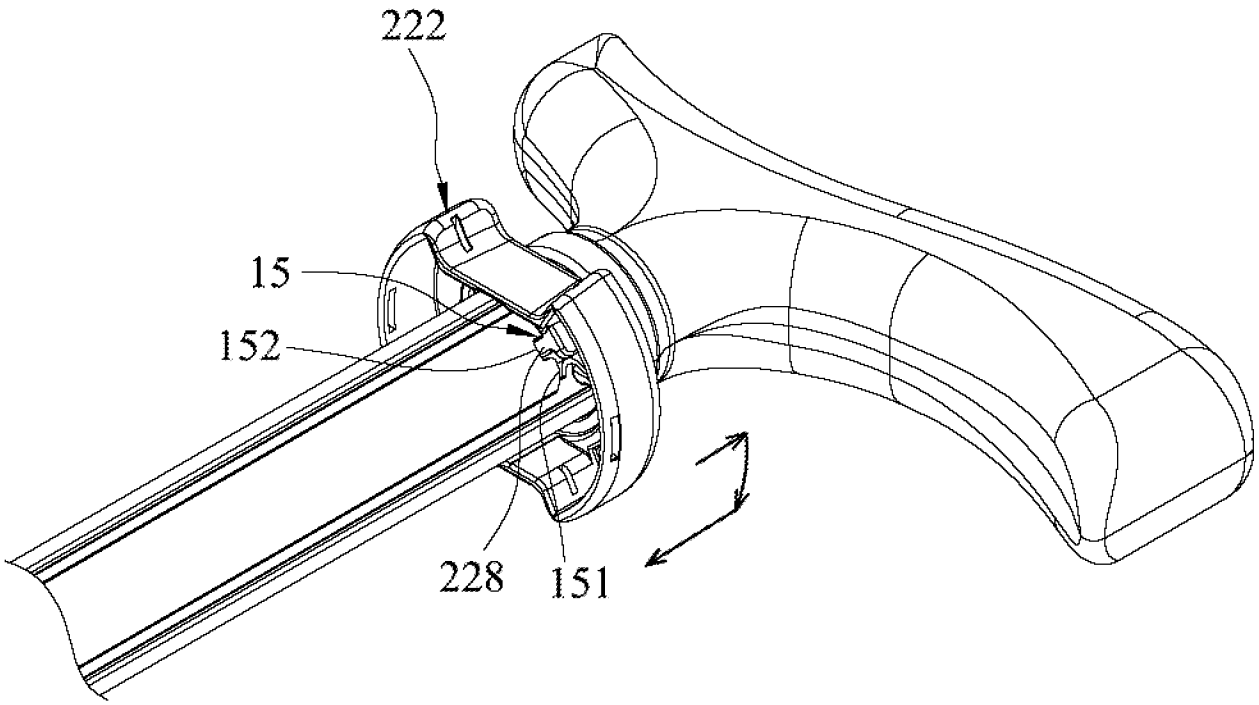
FIG. 10 is another schematic fragmentary perspective view of the embodiment illustrating the rotating member engaging an upper positioning groove.

Referring to FIG. 10, it is noted that when the upper slider assembly 22 is moved upwardly to register the engaging blocks 228 respectively with the upper positioning grooves 15, the rotating member 222 is biased by the locking resilient members 223 toward the locking position such that each of the engaging blocks 228 of the rotating member 222 first move within the slide section 15 of the respective one of the upper positioning grooves 15 and then biased by the second resilient members 27 to engage the prevention section 152 of the respective one of the upper positioning grooves 15 for preventing the rotating member 222 from rotating relative to the slider member 221 and retaining the fold unit 2 in the folded state.

To unfold the foldable chair of this invention, the upper slider assembly 22 is first moved upwardly to disengage the engaging blocks 228 of the rotating member 222 from the prevention sections 152 of the upper positioning grooves 15. Then, the rotating member 222 is rotated to the unlocking position against the biasing action of the locking resilient members 223, such that the engaging blocks 228 of the rotating member 222 are disengaged respectively from the upper positioning grooves 15, and are slidable respectively within the two of the guide grooves 13 to permit the upper slider assembly 22 to slide along the main stick 11.

To sum up, the foldable chair of this invention has the following advantages,

1. By virtue of the guide grooves 13, the upper and lower positioning grooves 15, 14, the engaging blocks 228 and the locking resilient members 223, the upper slider assembly 22 can be positioned easily relative to the main stick 11, and has a structure simpler than the positioning structure in Taiwanese Patent Application No. 102112330.

2. By virtue of the prevention sections 152 of the upper positioning grooves 15, the rotating member 222 is prevented from rotating relative to the slider member 221 when the foldable chair is folded, so as to improve the safety of the foldable chair.

It is noted that in another embodiment of this invention, the support legs 12 are omitted, and the connecting member 21 is connected fixedly to the main stick 11. Such a foldable chair may be used in mass transportation or public space.

While the present invention has been described in connection with what is considered the most practical embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A foldable chair, comprising:

a support unit including a main stick that extends along an axis, said main stick having a guide groove that is formed in an outer surrounding surface of said main stick and that extends in a longitudinal direction of said main stick, and a positioning groove that is formed in said outer surrounding surface, and that has a portion extending in a circumferential direction of said main stick and communicating spatially with said guide groove;

a fold unit including a connecting member that is connected to said main stick, an upper slider assembly that is connected to said main stick, that is located above said connecting member, and that is movable along said main stick, and a fold bar that has a proximal end connected pivotally to said connecting member and a free end opposite to said proximal end, said fold unit being operable to convert between an unfolded state and a folded state such that, when said fold unit is converted from the unfolded state into the folded state, a distance between said upper slider assembly and said connecting member is increased and a distance between said free end of said fold bar and said main stick is reduced; and a seat unit having a proximal end portion that is connected to said upper slider assembly, and a distal end portion that is opposite to said proximal end portion, said seat unit forming an angle relative to said main stick, and being supported by said fold bar when said fold unit is in the unfolded state, said distal end portion of said seat unit being moved toward said main stick when said fold unit is converted into the folded state, said upper slider assembly including a slider member and a rotating member that is connected rotatably to said slider member, said rotating member being rotatable relative to said slider member about the axis between a locking position, where said rotating member engages said positioning groove for positioning said upper slider assembly relative to said main stick and said connecting member, so as to prevent conversion of said fold unit between the unfolded state and the folded state, and an unlocking position, where said rotating member is disengaged from said positioning groove, so as to permit the conversion of said fold unit between the unfolded state and the folded state.

2. The foldable chair as claimed in claim 1, wherein said upper slider assembly further includes a resilient member that is disposed between said slider member and said rotating member for biasing resiliently said rotating member toward the locking position.

3. The foldable chair as claimed in claim 2, wherein said fold unit further includes a resilient member connected between said connecting member and said upper slider assembly for biasing resiliently said connecting member and said upper slider assembly toward each other.

4. The foldable chair as claimed in claim 2, wherein said resilient member is configured as a compression spring, and has opposite ends pushing respectively against said slider member and said rotating member.

5. The foldable chair as claimed in claim 1, wherein said main stick of said support unit has two said positioning grooves arranged one above the other, an upper one of said positioning grooves being proximate to an upper end of said main stick, a lower one of said positioning grooves being distal from said upper end of said main stick, said rotating member having a cap body and an engaging block that projects from said cap body, said engaging block being operable to engage the lower one of said positioning grooves for retaining said fold unit in the unfolded state, and to engage the upper one of said positioning grooves for retaining said fold unit in the folded state.

6. The foldable chair as claimed in claim 5, wherein the upper one of said positioning grooves has a slide section extending in the circumferential direction of said main stick and communicating spatially with said guide groove, and a prevention section extending away from said upper end of said main stick from one end of said slide section that is distal from said guide groove, said engaging block of said rotating member being operable to engage said prevention section of said upper positioning groove for preventing rotation of said rotating member relative to said slider member.

7. The foldable chair as claimed in claim 5, wherein said slider member of said upper slider assembly is formed with a block-engaging groove having a slide groove portion that extends in the circumferential direction of said main stick, said engaging block of said rotating member being movable within said slide groove portion.

8. The foldable chair as claimed in claim 7, wherein said block-engaging groove in said slider member further has an installation groove portion that extends from said slide groove portion and through an upper end of said slider member.

9. The foldable chair as claimed in claim 1, wherein said seat unit includes a main plate that has said proximal and distal end portions, and two lateral plates that are connected respectively and pivotally to opposite lateral sides of said main plate, each of said lateral plates having a guide rail that has a proximal end proximate to said proximal end portion of said main plate, and a distal end distal from said proximal end portion of said main plate, said fold unit including two said fold bars, said free end of each of said fold bars being connected pivotally to a respective one of said lateral plates, and being slidable along said guide rail of the respective one of said lateral plates, said main plate and said lateral plates being coplanar and said free end of each of said fold bars being at said distal end of said guide rail of the respective one of said lateral plates when said fold unit is in the unfolded state, said free end of each of said fold bars being at said proximal end of said guide rail of the respective one of said lateral plates and said main plate and said lateral plates cooperatively forming a U-shaped structure to cover said fold unit when said fold unit is in the folded state.

10. The foldable chair as claimed in claim 1, wherein said fold unit further includes a linking bar that has opposite ends connected respectively and pivotally to said upper slider assembly and said fold bar.

11. The foldable chair as claimed in claim 1, wherein said connecting member is movable along said main stick.

* * * * *